US012337880B2

(12) United States Patent
Kimura et al.

(10) Patent No.: US 12,337,880 B2
(45) Date of Patent: Jun. 24, 2025

(54) RAILROAD VEHICLE

(71) Applicant: HITACHI, LTD., Tokyo (JP)

(72) Inventors: Sota Kimura, Tokyo (JP); Kyouji Takahara, Tokyo (JP); Kimiyasu Yoshimura, Tokyo (JP)

(73) Assignee: HITACHI, LTD., Tokyo (JP)

( * ) Notice: Subject to any disclaimer, the term of this patent is extended or adjusted under 35 U.S.C. 154(b) by 719 days.

(21) Appl. No.: 17/635,986

(22) PCT Filed: Jun. 19, 2020

(86) PCT No.: PCT/JP2020/024128
§ 371 (c)(1),
(2) Date: Feb. 16, 2022

(87) PCT Pub. No.: WO2021/033405
PCT Pub. Date: Feb. 25, 2021

(65) Prior Publication Data

US 2022/0281492 A1 Sep. 8, 2022

(30) Foreign Application Priority Data

Aug. 21, 2019 (JP) ..... 2019-150838

(51) Int. Cl.
*B61F 1/14* (2006.01)
*B61F 1/12* (2006.01)
*B61F 5/04* (2006.01)

(52) U.S. Cl.
CPC ..... *B61F 1/14* (2013.01); *B61F 1/12* (2013.01); *B61F 5/04* (2013.01)

(58) Field of Classification Search
CPC ..... B61F 1/00; B61F 1/08; B61F 1/14; B61F 5/02; B61F 1/12; B61F 5/52; B61F 5/04
See application file for complete search history.

(56) References Cited

U.S. PATENT DOCUMENTS 475,023 A * 5/1892 Schoen ..... B61F 5/04 105/229
734,324 A * 7/1903 Hastings ..... B61F 1/12 105/228

(Continued)

FOREIGN PATENT DOCUMENTS

CN 107933597 A * 4/2018 ..... B61F 5/02
EP 2204309 A1 * 7/2010 ..... B61F 1/02

(Continued)

OTHER PUBLICATIONS

International Search Report of PCT/JP2020/024128 dated Aug. 25, 2020.

*Primary Examiner* — S. Joseph Morano
*Assistant Examiner* — Cheng Lin
(74) *Attorney, Agent, or Firm* — MATTINGLY & MALUR, PC

(57) ABSTRACT

A rail vehicle including an underframe that contributes to improvement in assembly and that is light in weight and high in rigidity is provided. The rail vehicle includes an underframe including a floor body structure that forms a floor surface and a bolster. The bolster includes a first shape member arranged at a middle portion of the bolster, at least part of the first shape member being formed by extrusion along a widthwise direction of the floor body structure, a second shape member connected to each of opposite end portions of the first shape member in the widthwise direction of the floor body structure, at least part of the second shape member being formed by extrusion along a lengthwise direction of the floor body structure, and a plate-shaped member connected to a side beam and connected to the second shape member.

5 Claims, 10 Drawing Sheets

(56) References Cited

U.S. PATENT DOCUMENTS

| | | | | | |
|---|---|---|---|---|---|
| 5,465,670 | A * | 11/1995 | Butcher | B61D 3/20 105/418 |
| 11,046,336 | B2 * | 6/2021 | Wang | B61F 1/08 |
| 2003/0136542 | A1 * | 7/2003 | Bauer | B22C 21/14 164/369 |
| 2015/0203130 | A1 * | 7/2015 | Langert | B61D 17/10 105/422 |

FOREIGN PATENT DOCUMENTS

| | | | | |
|---|---|---|---|---|
| EP | 2500231 | A1 | 9/2012 | |
| EP | 2500231 | B1 | 7/2015 | |
| JP | 2012025325 | A * | 2/2012 | |
| JP | 2017-013667 | A | 1/2017 | |
| WO | WO-2016178265 | A1 * | 11/2016 | B61F 1/12 |

* cited by examiner

RAILROAD VEHICLE

TECHNICAL FIELD

The present invention relates to a rail vehicle.

BACKGROUND ART

Generally, a vehicle body structure (hereinafter referred to as a body structure) is a hexahedron structure and includes an underframe that forms a floor surface, side body structures arranged at opposite end portions in a widthwise direction of the underframe, end body structures arranged at opposite end portions in a lengthwise direction of the underframe, and a roof body structure arranged on top of the side body structures and the end body structures.

A general underframe includes side beams that extend along the lengthwise direction of the underframe and that are arranged at opposite end portions in the widthwise direction of the underframe, an end beam that connects an end portion of the side beam in a lengthwise direction thereof to a corresponding end portion of the other side beam, a bolster that extends along the end beams and that is disposed at a position of a predetermined distance from an end portion in a lengthwise direction of the body structure, and an intermediate beam arranged along the lengthwise direction of the body structure for connecting the end beams and the bolster to the body structure.

A center pin provided along an upward and downward direction of the body structure on a lower surface of the bolster is connected to a bogie frame that configures a bogie. Upon acceleration and deceleration of the vehicle, a load in a vehicle forward and rearward direction is transmitted from the bogie to the bolster through the center pin.

Incidentally, from the point of view of improvement in assembly performance of a railway vehicle, it is demanded to facilitate attachment of wirings and ducts that are to be attached under the floor. In order to facilitate attachment, it is effective to attach them to the body structure with a fixed space provided between the underframe and the bolster in a state in which the bolster is attached to the bogie. As a bogie structure in which a bolster is incorporated in such a manner, a bogie that includes a bolster bolted only to a side beam is proposed in Patent Document 1.

PRIOR ART DOCUMENT

Patent Document

Patent Document 1: European Patent No. 2500231

SUMMARY OF THE INVENTION

Problems to be Solved by the Invention

In an underframe structure of a railway vehicle, in a case where such a structure that a bolster is connected only to a side beam is adopted, the bolster is subject to torsion deformation due to a moment load transmitted thereto from a bogie through a center pin. Further, the bolster is subject to bending deformation due to a vertical load transmitted thereto from the bogie through an air spring by vertical vibrations upon traveling of the railway vehicle.

In order to withstand such a moment load and vertical load as described above, according to the bogie structure disclosed in Patent Document 1, a bolster structure includes a rib of a cross section uniform along a widthwise direction of a vehicle body structure and a face plate. Therefore, according to such a bolster structure as described above, there is the possibility that the weight of the bolster may increase or that the size of the space between the bolster and the underframe may be restricted.

The present invention has been made in view of such a situation of the related art as described above, and it is an object of the present invention to provide a rail vehicle including an underframe that contributes to improvement in assembly performance and that is light in weight and high in rigidity.

Means for Solving the Problems

In order to solve the problems described above, one of representative rail vehicles according to the present invention is a rail vehicle that includes an underframe including a floor body structure that forms a floor surface, a side beam provided at each of opposite end portions in a widthwise direction of the floor body structure, an end beam provided at an end portion in a lengthwise direction of the floor body structure, and a bolster spaced from the end beam and disposed in such a manner as to extend across the side beams. The bolster includes a first shape member arranged at a middle portion of the bolster, at least part of the first shape member being formed by extrusion along the widthwise direction of the floor body structure, a second shape member connected to each of opposite end portions of the first shape member in the widthwise direction of the floor body structure, at least part of the second shape member being formed by extrusion along a lengthwise direction of the floor body structure, and a plate-shaped member connected to the side beam and connected to the second shape member. The first shape member is arranged such that a distance between the first shape member and the floor body structure is larger than a distance between the second shape member and the floor body structure.

Advantages of the Invention

According to the present invention, it is possible to provide a rail vehicle including an underframe that contributes to improvement in assembly performance and that is light in weight and high in rigidity.

Subjects, configurations, and advantageous effects other than those described above are made apparent by the following description of embodiments.

MODES FOR CARRYING OUT THE INVENTION

A rail vehicle is a generic name for vehicles that travel along a laid railway track, and signifies railway vehicles, streetcars, new transportation system vehicles, monorail vehicles, and other vehicles. In the following, embodiments of the present invention are described exemplifying a railway vehicle as a representative example of rail vehicles with reference to the drawings.

First, directions are defined. A lengthwise (rail) direction of the rail vehicle is defined as an X direction, a widthwise (sleeper) direction of the rail vehicle is defined as a Y direction, and a heightwise direction of the rail vehicle is defined as a Z direction. In the following description, they are referred to merely as the X direction, the Y direction, and the Z direction, in some cases.

Figure 1:
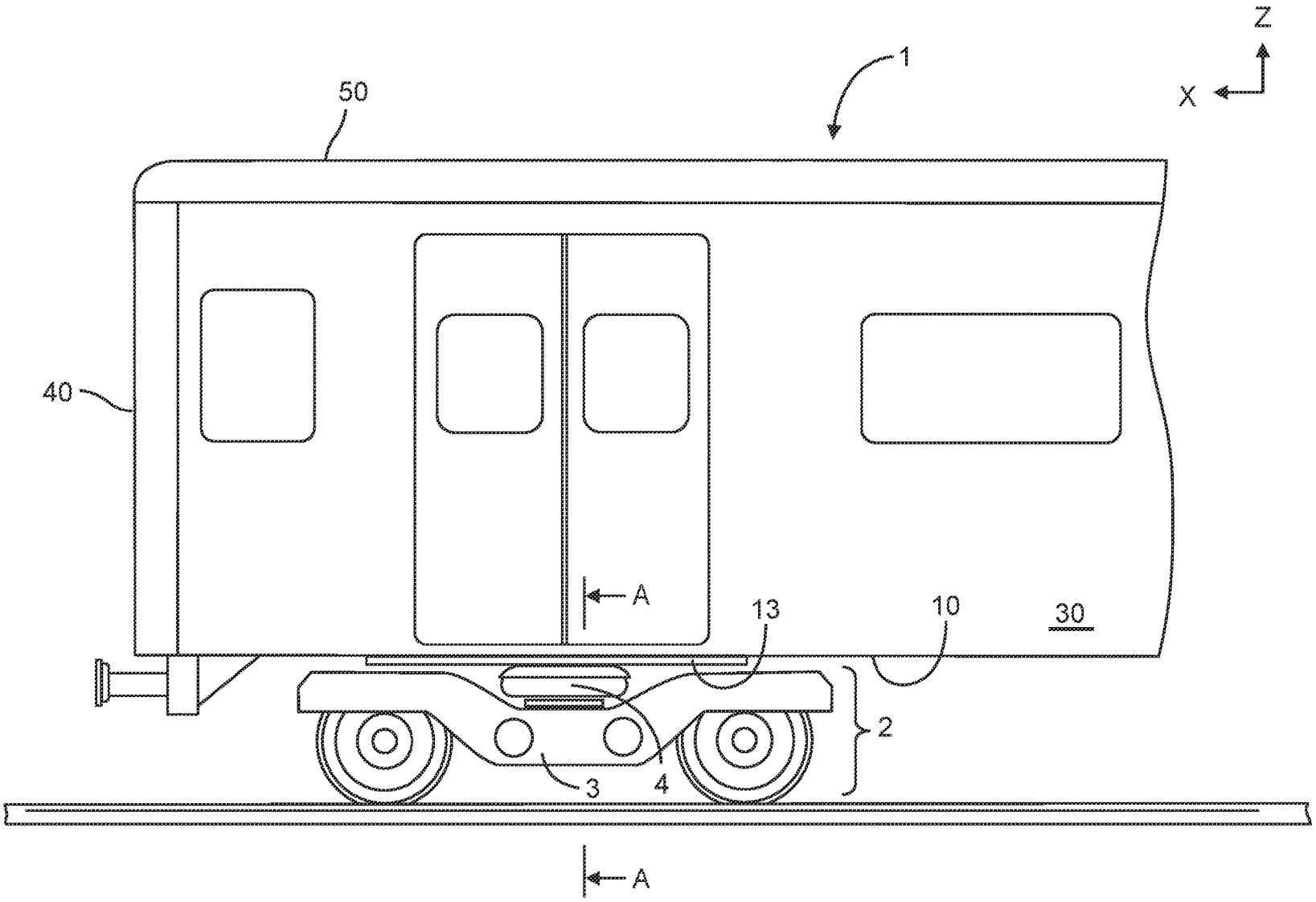
FIG. 1 is a side elevational view of a railway vehicle.
Figure 2:
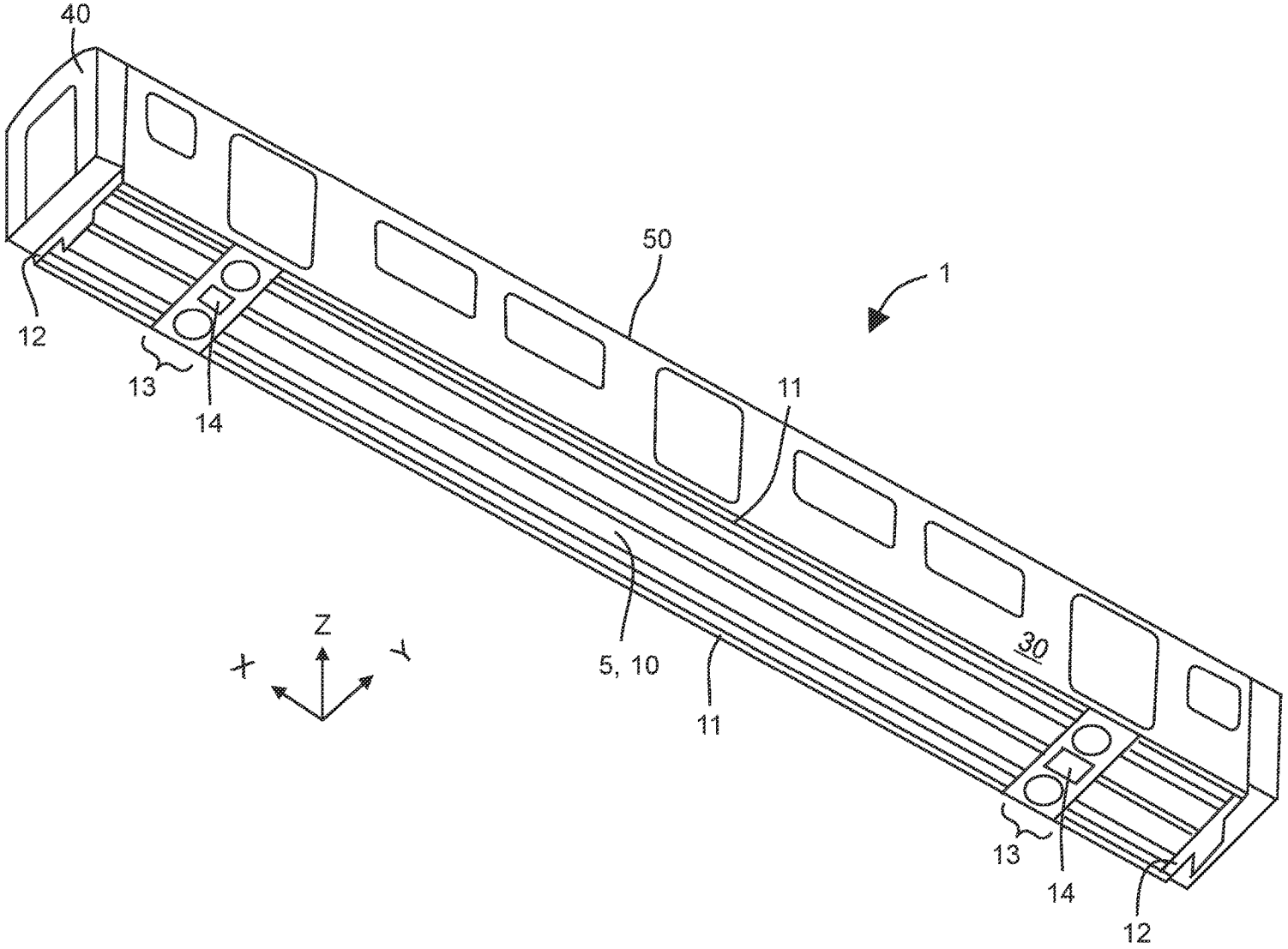
FIG. 2 is a perspective view of an underframe structure including a bolster of the railway vehicle as viewed from below.

FIG. 1 is a side elevational view of a railway vehicle, and FIG. 2 is a perspective view of an underframe structure including a bolster of the railway vehicle as viewed from below. A body structure 1 of the railway vehicle is a hexahedron and includes an underframe 10 that forms a floor surface, a side body structure 30 provided uprightly at each of opposite end portions of the underframe 10 in the Y direction, an end body structure 40 provided uprightly at each of opposite end portions of the underframe 10 in the X direction, and a roof body structure 50 placed on upper end portions of the side body structure 30 and the end body structure 40 in the Z direction.

Windows, side-sliding doors used when passengers get on and off, and so forth are provided on the side body structures 30. The body structure 1 is supported by bogies 2 at lower surfaces of opposite end portions of the body structure 1 in the X direction. Each of the bogies 2 includes a bogie frame and axles held on the bogie frame so as to be rotatable. The bogie frame includes a pair of side beams 3 and an intermediate beam. The pair of side beams 3 are arranged along the X direction and spaced from each other at opposite end portions in the Y direction. The intermediate beam connects middle portions of the pair of side beams 3 in the X direction to each other. The body structure 1 is elastically supported by air springs 4 provided at opposite end portions of the bogie frame in the Y direction.

The underframe 10 of the body structure 1 includes a pair of side beams 11 and an end beam 12. The pair of side beams 11 are arranged at opposite end portions of a floor body structure 5 (refer to FIG. 4) in the Y direction. The floor body structure 5 forms the floor surface. The end beam 12 is arranged at each or one of the opposite end portions in the X direction. A pair of bolsters 13 are provided at respective positions rather close to a middle portion in the X direction from the end beams 12 in such a manner as to extend along a lengthwise direction of the end beams 12 (along the Y direction). Each of the bolsters 13 is welded or is mechanically fastened using bolts or the like to a predetermined position in such a manner as to extend across the pair of side beams 11 after the floor body structure 5, the side beams 11, and the end beams 12 are welded together and are integrally configured, for example.

Each bolster 13 is supported at opposite end portions thereof in the Y direction by a pair of the air springs 4 (refer to FIG. 4) provided on the bogie 2. A center pin 14 is provided at a middle portion of the bolster 13 in the Y direction in such a manner as to extend downwardly along the Z direction. The bogie 2 pivots around the center pin 14 as an axis and turns along a curvature of the railway track in a substantially horizontal plane.

First Embodiment

Figure 3:
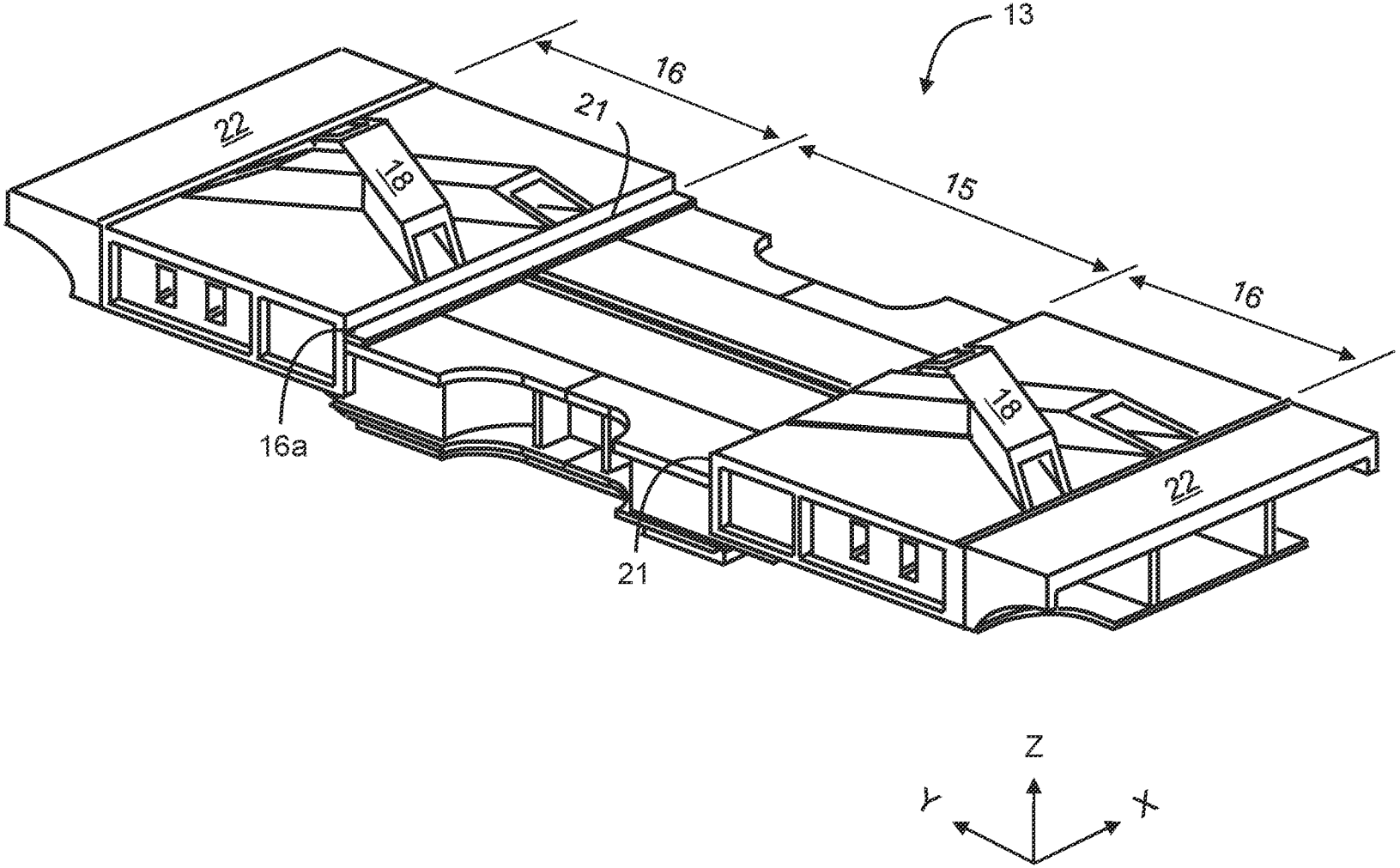
FIG. 3 is a perspective view of the bolster according to a first embodiment.
Figure 4:
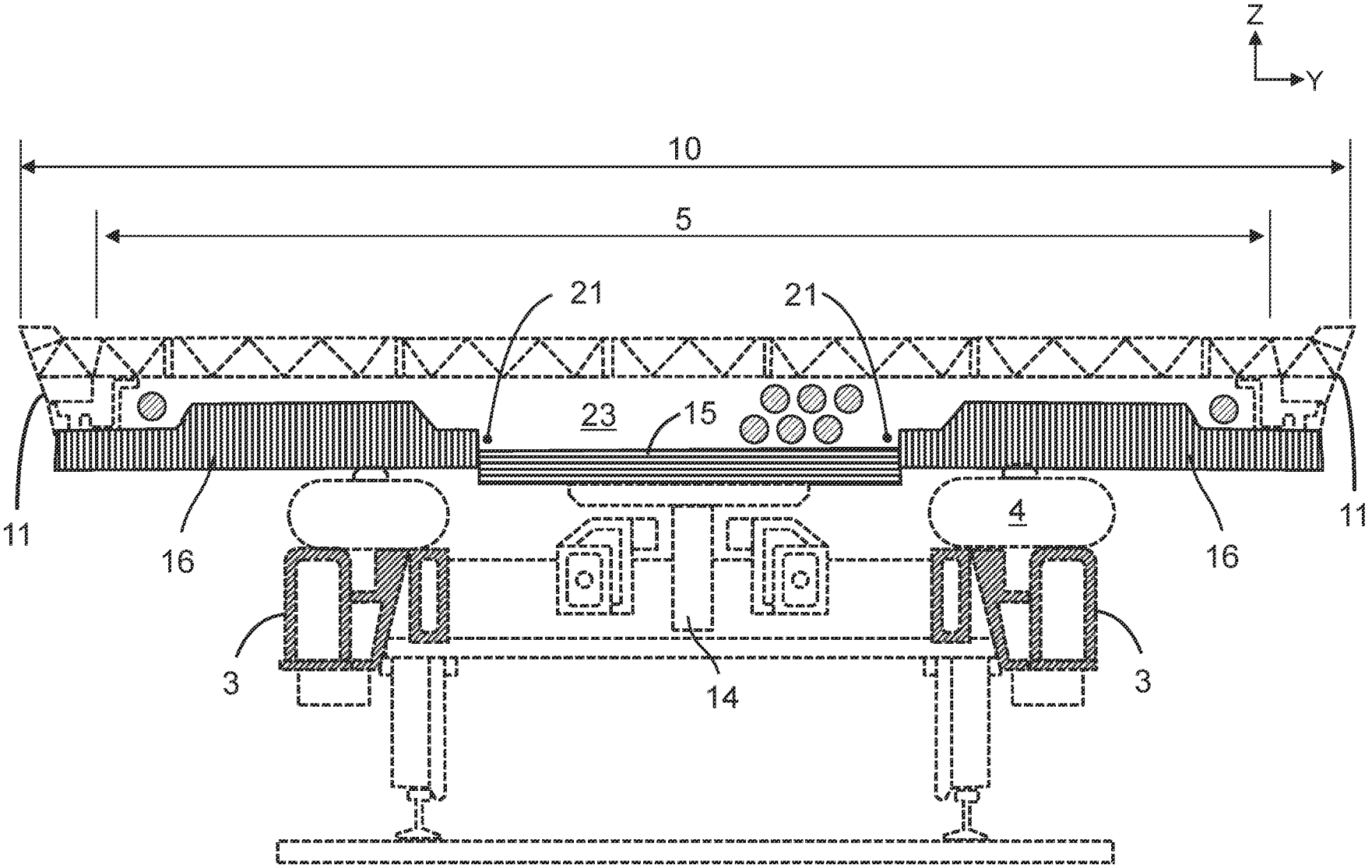
FIG. 4 is a cross sectional view (corresponding to an A-A cross section of FIG. 1) of a railway vehicle including the bolster according to the first embodiment.
Figure 5:
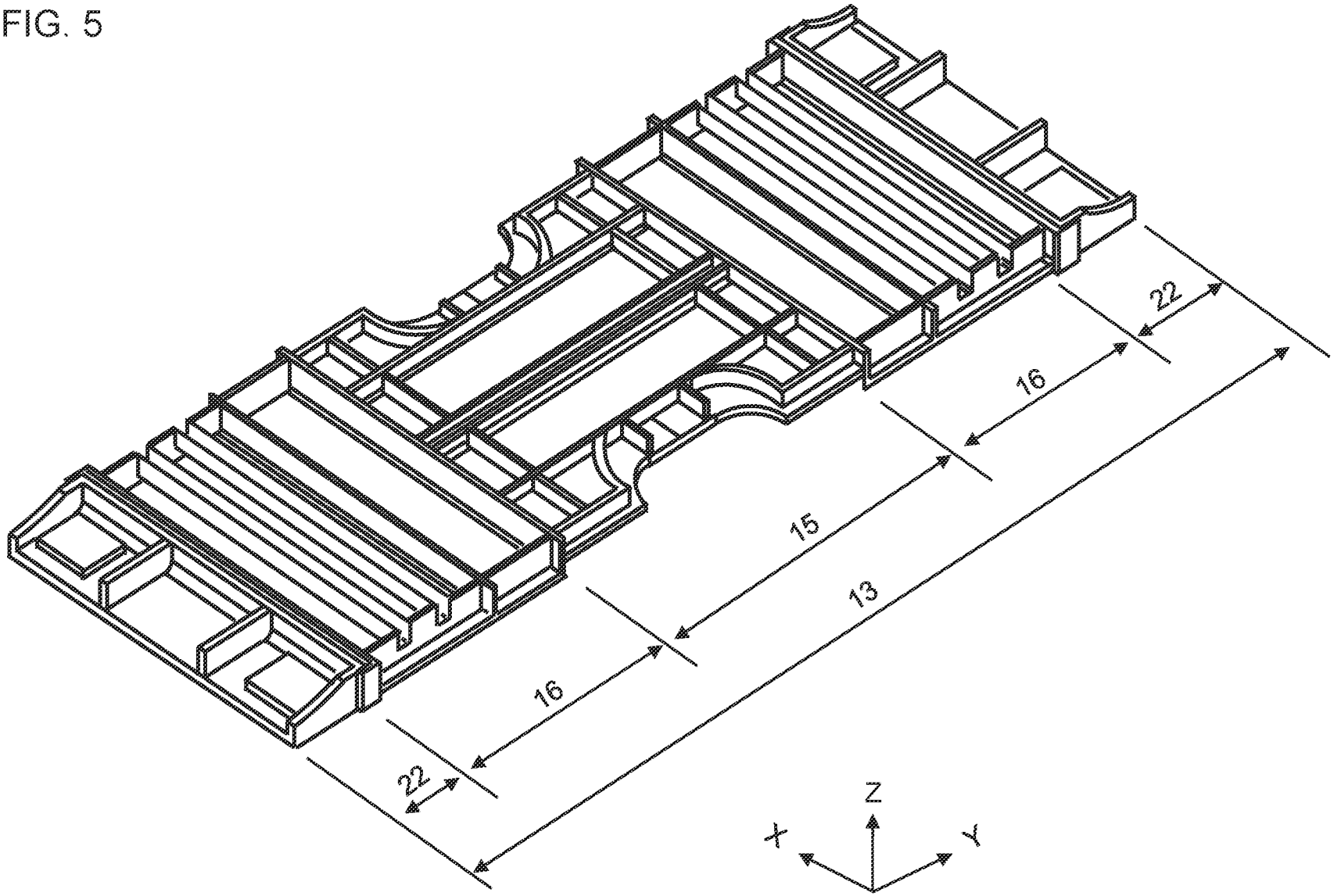
FIG. 5 is a cross sectional view taken along a horizontal plane of a middle portion in a heightwise direction of the bolster according to the first embodiment.
Figure 6:
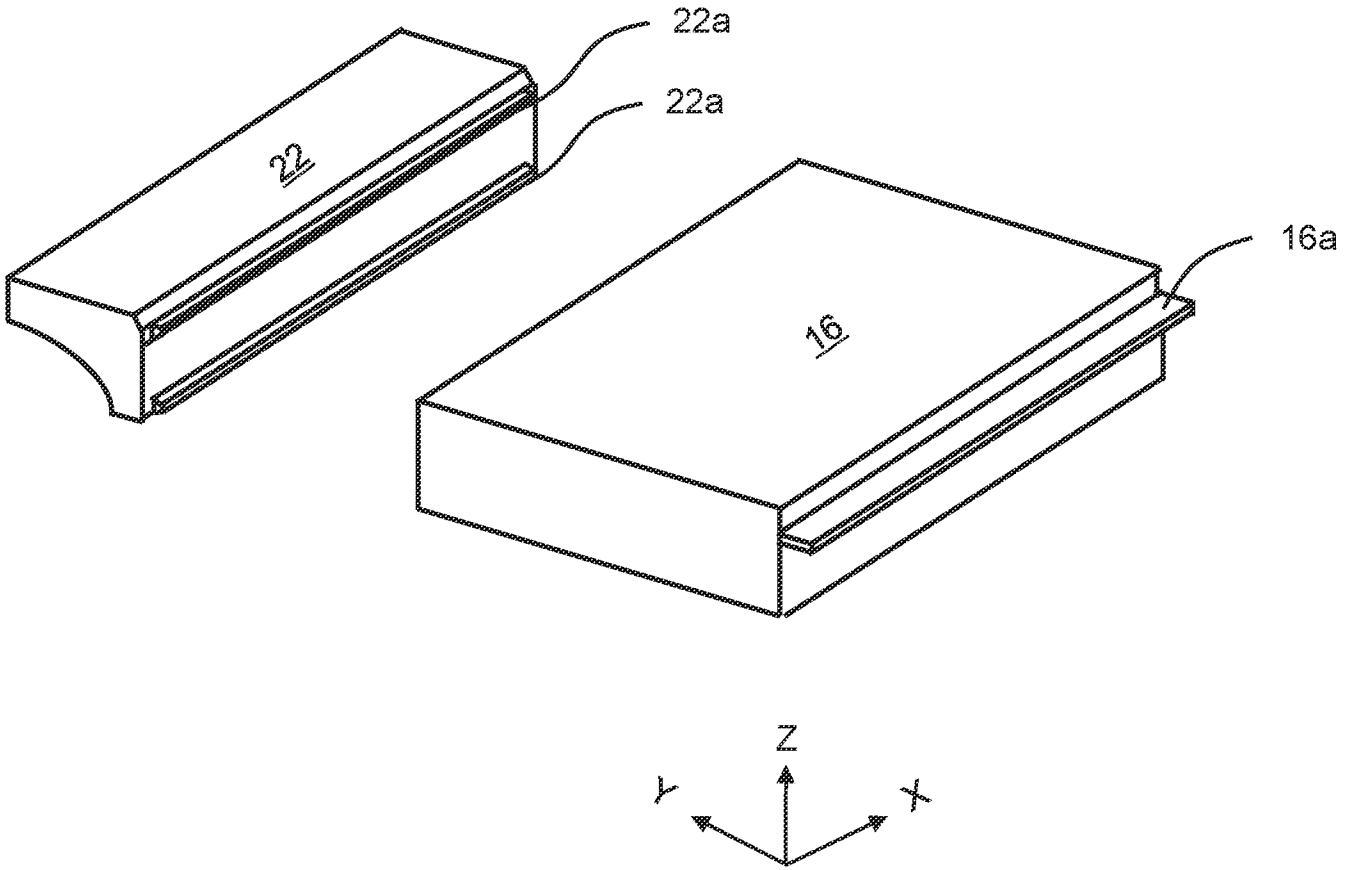
FIG. 6 is a perspective view of a joining portion between an end member in a lengthwise direction of the bolster and a bolster member of the bolster that supports an air spring, the end member being configured to be connected to a side beam included in the underframe.

FIG. 3 is a perspective view of the bolster according to a first embodiment, and FIG. 4 is a cross sectional view (corresponding to an A-A cross section of FIG. 1) of a railway vehicle that includes the bolster according to the first embodiment. FIG. 5 is a cross sectional view taken along a horizontal plane of a middle portion in a heightwise direction of the bolster according to the first embodiment, and FIG. 6 is a perspective view of a joining portion between an end member in a lengthwise direction of the bolster and a bolster member of the bolster that supports the air spring, the end member being configured to be connected to the side beam included in the underframe.

Referring to FIGS. 3 and 5, the bolster 13 includes a shape member (also referred to as a first shape member) 15, shape members (each referred to also as a second shape member) 16, and plate-shaped members 22. The shape member 15 is arranged at a middle portion of the bolster 13 in the Y direction and is formed by extrusion along the Y direction. The shape members 16 are connected to opposite end portions of the shape member 15 in the Y direction and are formed by extrusion along the X direction. Each of the plate-shaped members 22 is connected to an end portion of the corresponding shape member 16 in the Y direction and connected to the corresponding side beam 11 included in the underframe 10. It is to be noted that at least part of the shape member 15 and the shape member 16 may be formed by extrusion.

Since positions of the shape member 15 and the shape member 16 are different in height, there is a step 21 along the X direction at a connection portion between the shape member 15 and the shape member 16. As the step 21 is provided, the height of a surface of the shape member 15 in the Z direction is set lower than the height of a surface of the shape member 16 in the Z direction (in a direction in which the distance between the shape member 15 and the floor body structure 5 is greater than the distance between the shape member 16 and the floor body structure 5). The dimension of the step 21 in the Z direction is defined according to a position of a positioning portion 16*a* in the Z direction that is provided on the shape member 16 (refer to FIG. 6). In other word, as depicted in FIG. 3, the step 21 is generated by placing the positioning portion 16*a* on an upper surface of an end portion of the shape member 15 and serves as a positioning reference when the shape member 15 is connected to the shape member 16. When the shape member 16 is extruded in a lengthwise direction of the body structure 1 (floor body structure 5), this positioning portion 16*a* is integrally formed on a surface of the shape member 16 (that comes into contact with the shape member 15) by the extrusion, and the dimension of the step 21 in the Z direction can thus be secured with high accuracy.

A pair of upper and lower projections 22*a* (refer to FIG. 6) are provided on a surface of a plate-shaped member 22 that comes into contact with the shape member 16. The projections 22*a* are fitted into recessed portions (not depicted) provided on a surface of the shape member 16. This can reduce man-hours when the plate-shaped member 22 and the shape member 16 are joined together.

With the abovementioned configuration of the bolster 13, the plate-shaped members 22 placed at the opposite end portions of the bolster 13 in the Y direction are joined to the side beams 11, which are included in the underframe 10, by using bolts or the like while a predetermined space 23 (FIG. 4) is provided between the underframe 10 and the bolster 13. Bending deformation of the bolster 13 caused by a vertical load transmitted from the bogie 2 through the air springs 4 is reduced by bending rigidity of the shape member 15 formed by extrusion along the Y direction. Further, torsion deformation of the bolster 13 caused by a bending moment load in an X-Z plane that is generated when tractive force or brake force of the bogie 2 is transmitted through the center pin 14 is reduced by torsional rigidity of the shape member 16 formed by extrusion along the X direction.

In addition, as depicted in FIG. 3, reinforcing members 18 that are put together in an X shape as viewed in top plan are arranged on and joined to an upper surface of the shape member 16. Accordingly, bending rigidity of the shape member 16 can be improved, and deformation of the bolster 13 at the time of transmission of a load from the bogie 2 to the bolster 13 can be reduced. Moreover, by adjusting the size of the step 21, a space of various sizes can be provided between the underframe 10 and the bolster 13, and such a space can be used as a space for arranging therein various members or parts such as pipes, ducts, sensors, and anti-vibration materials.

Second Embodiment

Figure 7:
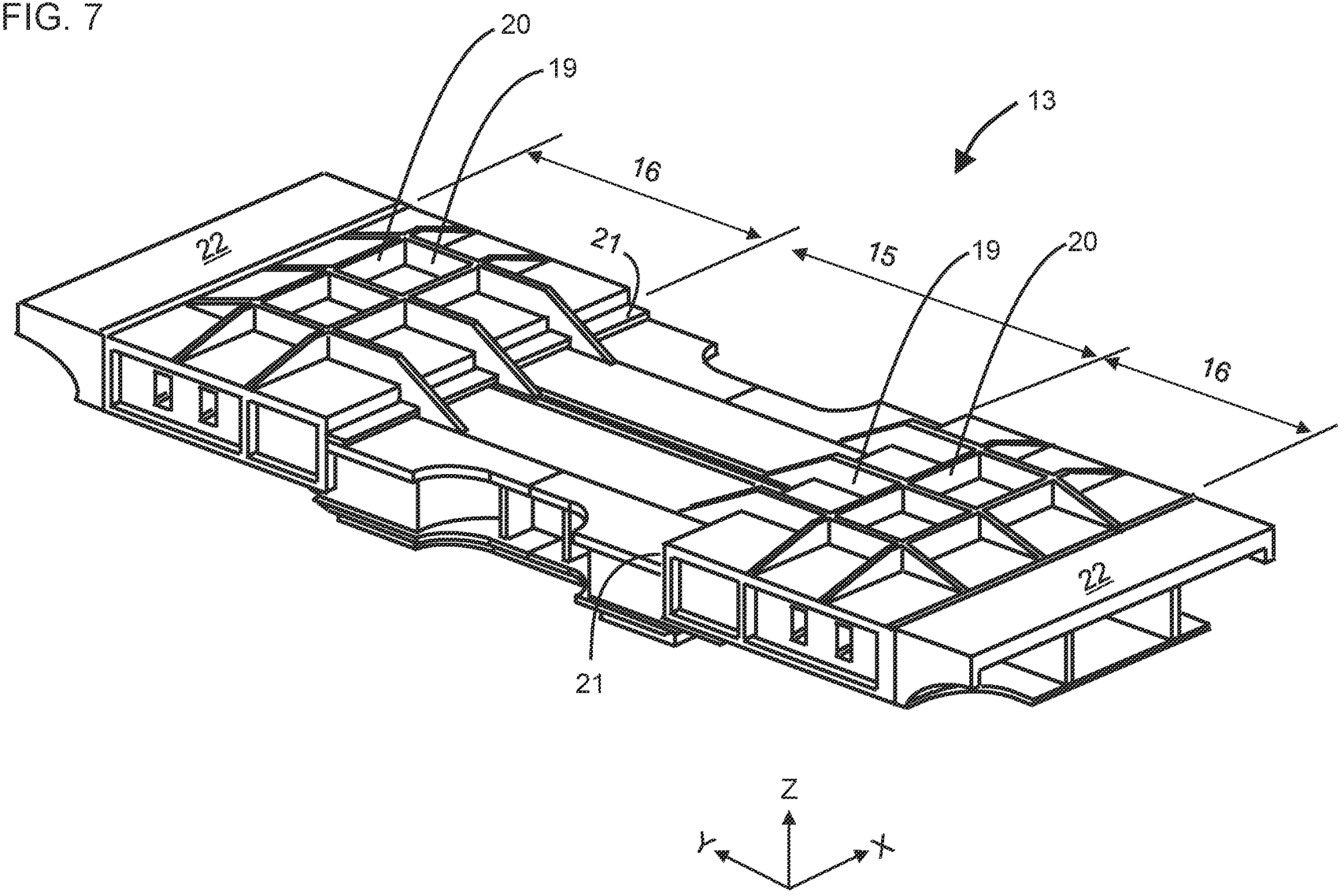
FIG. 7 is a perspective view of a bolster according to a second embodiment.

Here, description is given focusing on a configuration unique to a second embodiment while description of a configuration common to that of the first embodiment is omitted. FIG. 7 is a perspective view of a bolster according to the second embodiment. According to the second embodiment, the bolster 13 of the first embodiment is modified such that reinforcing members 19 and reinforcing members 20 each having a substantially trapezoidal plate shape are arranged in a grid pattern as viewed in a top plan and joined to the upper surface of the shape member 16 included in the bolster 13. The reinforcing members 19 extend along the Y direction, and the reinforcing members 20 extend along the X direction. Each reinforcing member 19 is joined in such a manner that part of the reinforcing member 19 extends beyond the step 21 and reaches an upper surface of the shape member 15, thereby to achieve reduction in stress at the joining portions between the shape member 15 and the shape members 16.

Since the reinforcing members 19 and the reinforcing members 20 are provided in the present embodiment, it is possible to increase the bending rigidity and the torsional rigidity of the shape members 16 compared to those in the first embodiment and to reduce the deformation of the bolster 13 when a load is transmitted from the bogie 2 to the bolster 13. Specifically, by adjusting the rib position of the shape member 16 and the position of the reinforcing members 20 in a widthwise direction of the vehicle body structure, it is possible to significantly increase the torsional rigidity.

Third Embodiment

Figure 8:
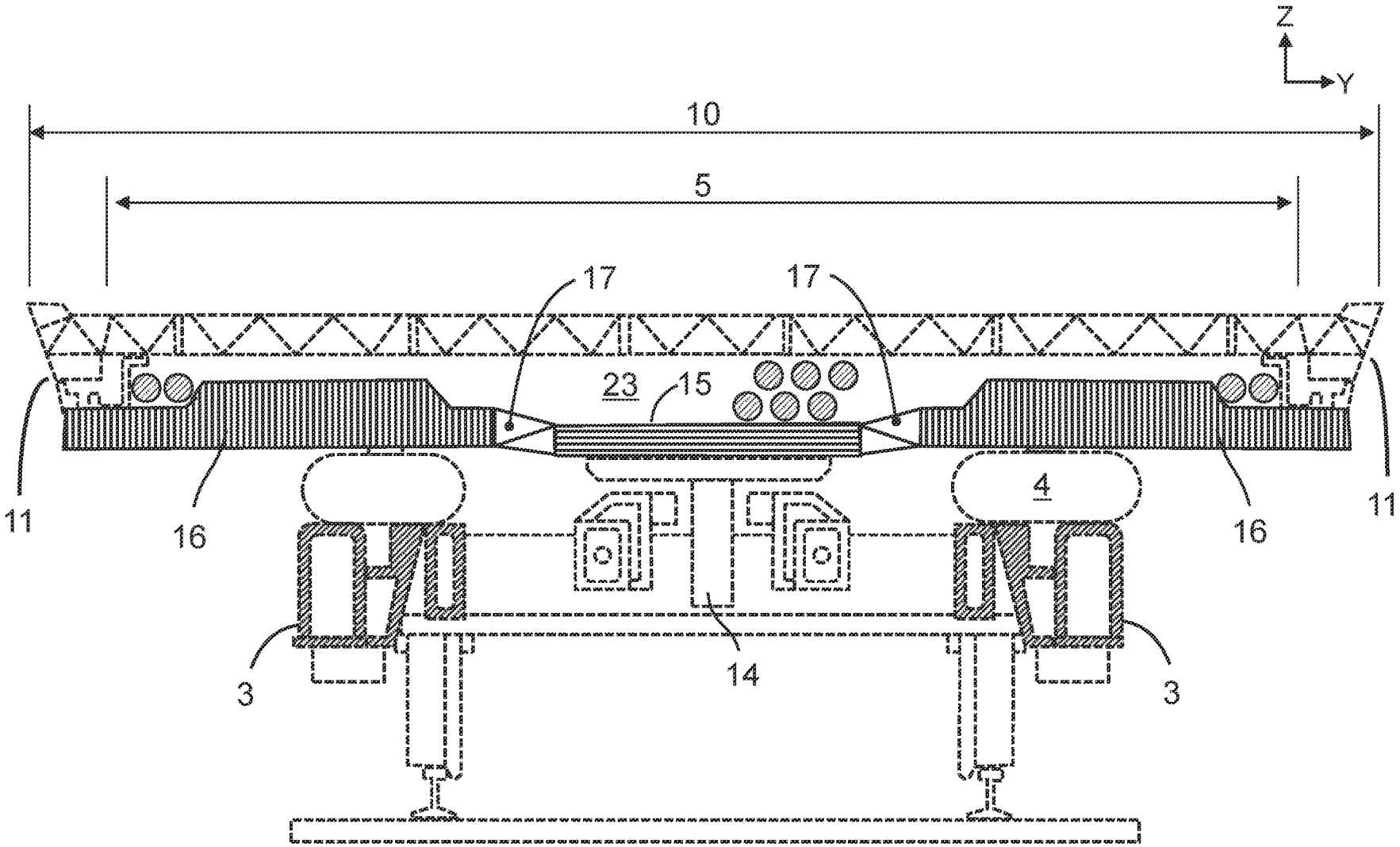
FIG. 8 is a cross sectional view (corresponding to an A-A cross section of FIG. 1) of a railway vehicle that includes a bolster according to a third embodiment.

Here, description is given focusing on a configuration unique to a third embodiment while description of a configuration common to those of the first and second embodiments is omitted. FIG. 8 is a cross sectional view (corresponding to an A-A cross section of FIG. 1) of a railway vehicle that includes a bolster according to the third embodiment In the bolster 13 according to the third embodiment, as depicted in FIG. 8, the bolster structure of the first embodiment or the second embodiment is modified such that the shape member 15 and each shape member 16 are connected to each other with a shape member (also referred to as a third shape member) 17 interposed therebetween. The shape member 17 is formed by extrusion in the X direction and has a parallelogram cross sectional shape (truss structure). Upper and lower surfaces of the shape member 17 have a predetermined angle with respect to a contact surface between the shape member 17 and the shape member 15 and a contact surface between the shape member 17 and the shape member 16, and the shape member 15 is shifted downwardly in the Z direction with respect to the shape member 16.

Since the shape member 17 is provided in the present embodiment, the shape member 15 and the shape member 16 are connected smoothly to each other, and therefore, increase in the joining strength and enhancement of the reliability at the joining position become possible.

Fourth Embodiment

Here, description is given focusing on a configuration unique to a fourth embodiment while description of a configuration common to those of the first, second, and third embodiments is omitted.

Figure 9:
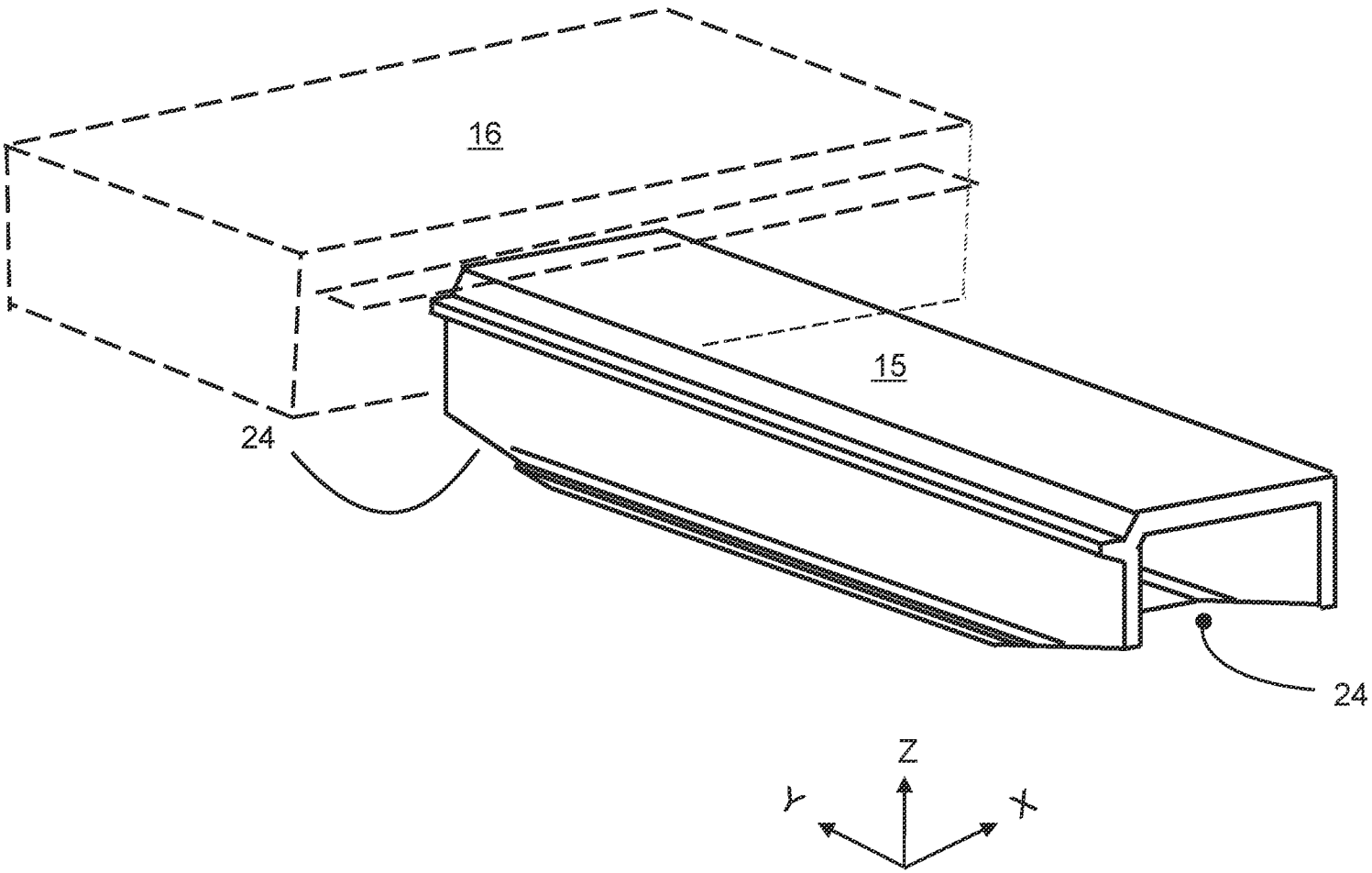
FIG. 9 is a perspective view of a joining portion of a shape member that is a middle portion in a lengthwise direction of a bolster according to a fourth embodiment.

FIG. 9 is a perspective view of a joining portion of a shape member that is a middle portion in a lengthwise direction of a bolster according to the fourth embodiment. In the bolster 13 according to the fourth embodiment, as depicted in FIG. 9, the bolster structure of any one of the first to third embodiments is modified such that the shape member 15 includes predetermined cutouts 24 at positions with which the shape members 16 come into contact. The cutouts 24 are formed by cutting portions of a lower surface of the shape member 15 in the proximity of opposite end portions thereof in the Y direction.

Consequently, it becomes possible to insert a welding torch into the inside of the shape member 15 at the connection position between the shape member 15 and the shape member 16 through corresponding one of the cutouts 24 that are provided on the opposite sides of the face plate forming the shape member 15, to weld the contact portion between both shape members. Also, it becomes possible to increase the joining strength and enhance the reliability at the connection position. An opening may be provided instead of the cutout.

Fifth Embodiment

Figure 10:
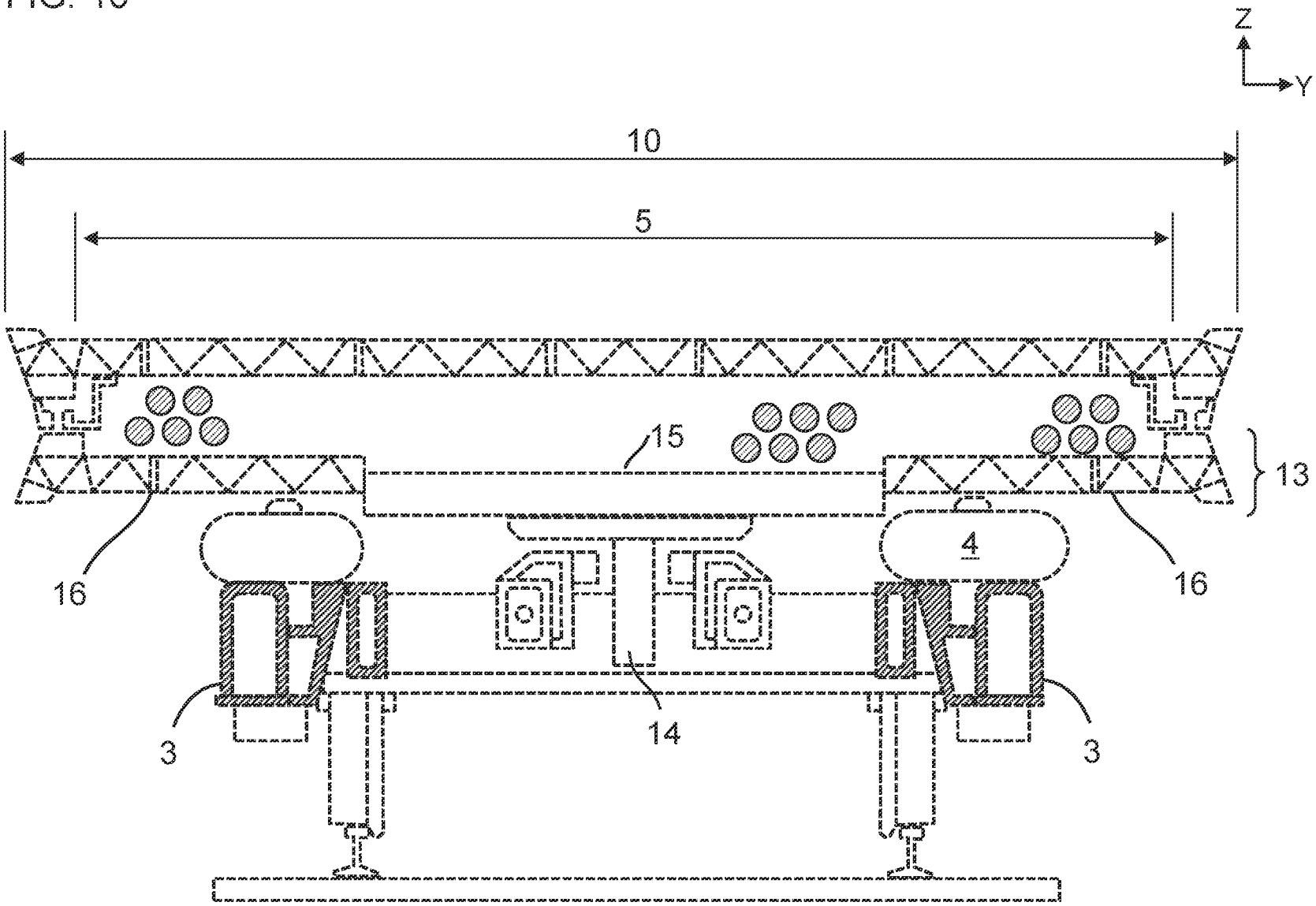
FIG. 10 is a cross sectional view (corresponding to an A-A cross section of FIG. 1) of an underframe that includes a bolster according to a fifth embodiment.

Here, description is given focusing on a configuration unique to a fifth embodiment while description of a configuration common to those of the first to fourth embodiments is omitted. FIG. 10 is a cross sectional view (corresponding to an A-A cross section of FIG. 1) of an underframe that includes a bolster according to the fifth embodiment.

In the bolster 13 according to the fifth embodiment, as depicted in a cross sectional view of the bolster and the underframe in FIG. 10, the bolster structure of any one of the first to fourth embodiments is modified such that the shape member 16 includes an extruded shape member of a cross sectional shape same as that of an extruded shape member included in the vehicle body structure (for example, a floor body structure). Further, the shape member 15 may include an extruded shape member of the same cross sectional shape. In this way, the shape member can be made common to both the bolster and the vehicle body structure, and therefore, reduction in number of parts and reduction in cost of the vehicle with the reduced number of parts can be achieved.

Although, in the embodiment described above, the bolster includes extruded shape members and reinforcement members that are made of an aluminum alloy, it is also possible to use a material having anisotropy, such as CFRP in which fibers are oriented at predetermined angles, for the purpose of reinforcement of members. Also, it is possible to employ such a configuration that a member for receiving a load from a yaw damper attached to the bogie 2 is attached to the bolster 13.

It is to be noted that the present invention is not limited to the embodiments described above and includes various modifications. For example, while the detailed description of the abovementioned embodiments are given in order to facilitate understanding of the present invention, the present invention is not necessarily limited to the embodiments that include all configurations described above. In addition, it is possible to replace part of the configuration of a certain embodiment with the configuration of another embodiment, and it is also possible to add the configuration of a certain embodiment to the configuration of another embodiment. Moreover, it is possible to add, delete, or replace a different configuration to, from, or with part of the configuration of each embodiment.

DESCRIPTION OF REFERENCE CHARACTERS

1: Body structure
2: Bogie
3: Side beam of bogie
4: Air spring
5: Floor body structure
10: Underframe
11: Side beam
12: End beam
13: Bolster
14: Center pin
15: Shape member whose extruded direction is along vehicle widthwise direction
16: Shape member whose extruded direction is along vehicle lengthwise direction
16*a*: Positioning portion
17: Shape member having parallelogram cross section
18: Reinforcing member
19: Reinforcing member along vehicle widthwise direction
20: Reinforcing member along vehicle lengthwise direction
21: Step
22: Plate-shaped member
22*a*: Projection
23: Space
24: Cutout
30: Side body structure
40: End body structure
50: Roof body structure
X: Lengthwise direction
Y: Widthwise direction
Z: Heightwise direction

The invention claimed is:

1. A rail vehicle comprising:
an underframe that includes:
a floor body structure that forms a floor surface,
a side beam provided at each of opposite end portions in a widthwise direction of the floor body structure,
an end beam provided at an end portion in a lengthwise direction of the floor body structure, and
a bolster spaced from the end beam and disposed in such a manner as to extend across the side beam,
wherein the bolster includes:
a first shape member arranged at a middle portion of the bolster, at least part of the first shape member being formed by extrusion along the widthwise direction of the floor body structure,
a second shape member connected to each of opposite end portions of the first shape member in the widthwise direction of the floor body structure, at least part of the second shape member being formed by extrusion along a lengthwise direction of the floor body structure, and
a plate-shaped member connected to the side beam and connected to the second shape member,
wherein the first shape member is arranged such that a distance between the first shape member and the floor body structure is larger than a distance between the second shape member and the floor body structure,
wherein a step is provided at a joining portion between the first shape member and the second shape member, and
wherein the second shape member has, on a surface thereof that comes into contact with the first shape member, a positioning portion for defining a position of the step, and the positioning portion is formed integrally with the second shape member by extrusion along the lengthwise direction of the floor body structure.

2. The rail vehicle according to claim 1,
wherein the first shape member has a cutout at a lower portion of each of the opposite end portions of the first shape member in the widthwise direction of the floor body structure.

3. The rail vehicle according to claim 1,
wherein the first shape member and the second shape member are connected to each other with a third shape member interposed therebetween, the third shape member being formed by extrusion along the lengthwise direction of the floor body structure and having a parallelogram cross sectional shape.

4. The rail vehicle according to claim 1,
wherein the second shape member has, on an upper surface thereof, reinforcement members that are put together in an X shape or arranged in a grid pattern as viewed in top plan.

5. The rail vehicle according to claim 1,
wherein at least either the first shape member or the second shape member is formed using an extruded shape member having a cross sectional shape same as a cross sectional shape of the floor body structure.

* * * * *